US006683574B2

(12) United States Patent
Su

(10) Patent No.: US 6,683,574 B2
(45) Date of Patent: Jan. 27, 2004

(54) TWIN MONOPOLE ANTENNA

(75) Inventor: Hsin-Cheng Su, Tainan (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/236,960

(22) Filed: Sep. 9, 2002

(65) Prior Publication Data

US 2003/0117322 A1 Jun. 26, 2003

(30) Foreign Application Priority Data

Dec. 26, 2001 (TW) ..... 90132410

(51) Int. Cl.[7] ..... H01Q 1/38
(52) U.S. Cl. ..... 343/700 MS; 343/846
(58) Field of Search ..... 343/700 MS, 702, 343/829, 846, 848, 849; H01Q 1/38

(56) References Cited

U.S. PATENT DOCUMENTS 4,130,822 A * 12/1978 Conroy ..... 343/700 MS
4,131,893 A * 12/1978 Munson et al. ..... 343/700 MS
4,679,233 A * 7/1987 Richardson et al. ... 379/433.02
5,565,877 A * 10/1996 Du et al. ..... 343/715
6,133,883 A * 10/2000 Munson et al. ..... 343/700 MS
6,313,798 B1 * 11/2001 Bancroft et al. ..... 343/700 MS
6,606,057 B2 * 8/2003 Chiang et al. ..... 342/374

* cited by examiner

*Primary Examiner*—Tho Phan

(57) ABSTRACT

A twin monopole antenna is disclosed. This twin monopole antenna comprises: a substrate having a first surface and a second surface; an upper ground plane that is located on the first surface of the substrate and comprises: a first ground plane, a second ground plane and a third ground plane; a lower ground plane that is located on the second surface of the substrate and comprises: a fourth ground plane; and an inverted-U shaped ground plane having a hollow rectangular surface; a first radiating line located on the first surface of the substrate, wherein a first included angle is located between the first radiating line and the second ground plane; and a second radiating line located on the first surface of the substrate, wherein a second included angle is located between the second radiating line and the second ground plane, and an interval between the first radiating line and the second radiating line. There is a valuable implementation in industrial field because the twin monopole antenna of the present invention can be operated in high frequency bands, and meanwhile provide a broader radiating and receiving pattern. Moreover, the present invention can be printed on a substrate, so that the present invention is easy to be integrated with other associated circuitries and the cost is lowered.

21 Claims, 9 Drawing Sheets

$\Phi = 180^\circ$ (XZ-Plane)

$\Phi = 270^\circ$ (YZ-Plane)

$\Theta = 90^\circ$ (XY-Plane)

TWIN MONOPOLE ANTENNA

FIELD OF THE INVENTION

The present invention relates to a twin monopole antenna, and more particularly relates to a twin monopole antenna that is fed by a twin coplanar waveguide and provided for radiating and receiving high-frequency signals in wireless communication systems.

BACKGROUND OF THE INVENTION

With the advancement of communication technologies, the applications using communication technologies have been increased significantly and the related products have also become more diversified. Especially, consumers have more demands for the functions of communication applications, so that there are many communication applications with different designs and functions continuously appearing in the market. For example, the products with one-piece design of dual-band or triple-band, and the computer network products with wireless communication functions are the main streams in the current market. Moreover, by utilizing IC technologies, the size of products will become smaller in future.

The function of antenna is mainly to radiate and receive signals in communications products, so that the designs and studies of antenna are quite important. In accordance with the demands of operations, there are numerous functions developed for communication products, so that the design of antenna has to be quite diversified, such as a rhombic antenna, a turnstile antenna, an invert-F antenna and a patch antenna, etc., for meeting the requirements various communication products. On the other hand, the properties of antenna are generally known by the parameters of operating frequency, radiation pattern, return loss, and antenna gain, etc.

Among various types of designs, a conventional patch monopole antenna has the attractive features of flatness, simple structure, easy design, etc. Therefore, the conventional patch monopole antenna is very suitable for use in applications in the current communication products. The conventional patch monopole antenna has been utilized popularly in various products and communication systems recently.

However, in common communication systems, the conventional patch monopole antenna cannot provide a better signal-radiating and signal-receiving performance in high frequency, so that the utilization of conventional patch monopole antenna has been limited in the current trend that is gradually moving towards high operation frequency and broader bandwidth.

SUMMARY OF THE INVENTION

In the view of the background of the invention described above, an antenna is an important part in wireless communications, since the overall performance of wireless communications is greatly affected by the antenna. Therefore, the features of low cost, high efficiency and simple implementation are the major trends for the design of antenna. Since the conventional patch monopole antenna has several advantageous features, such as flatness, simple structure and easy design, etc., the conventional patch monopole antenna has been popularly used. However, for the conventional patch monopole antenna has the disadvantage of low efficiency in high-frequency operation, the conventional patch monopole antenna cannot be utilized broadly.

Therefore, it is the principal object of the present invention to provide a twin monopole antenna, and more particularly to provide a twin monopole antenna that is fed by a twin coplanar waveguide. The present invention is to attain and provide more complete functions and the range of higher operating frequency by operating the twin monopole antenna of the present invention in different frequency bands, wherein the twin monopole antenna of the present invention has two radiating metal lines, whereby either one of two radiating metal lines can be switched by RF circuit for performing the radiating and receiving operations for the twin monopole antenna in accordance with the environmental signal intensity. Moreover, the implementation of the present invention is valuable in industrial fields, because the twin monopole antenna of the present invention can be printed on a substrate, which makes it easy to be integrated with other associated circuitries.

In accordance with the aforementioned purpose of the present invention, the present invention provides a twin monopole antenna. The twin monopole antenna of the present invention comprises: a substrate having a first surface and a second surface; an upper ground plane that is located on the first surface of the substrate and comprises: a first ground plane, a second ground plane and a third ground plane; a lower ground plane that is located on the second surface of the substrate and comprises: a fourth ground plane; and an inverted-U shaped ground plane having a hollow rectangular surface; a first radiating line located on the first surface of the substrate, wherein a first included angle is located between the first radiating line and the second ground plane; and a second radiating line located on the first surface of the substrate, wherein a second included angle is located between the second radiating line and the second ground plane, and an interval between the first radiating line and the second radiating line.

The main radiating component of the twin monopole antenna of the present invention resides in a structure of two radiating metal lines that are fed and driven by twin coplanar waveguide. According to the design parameters of two radiating metal lines, such as lengths, widths, shapes and included angles, the twin monopole antenna of the present invention can be operated in different frequency bands, and the frequency ratio thereof is also adjusted easily. Moreover, since the radiating metal lines and the ground plane are printed directly on a substrate, the cost is thus lowered and the manufacture can be processed easily.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
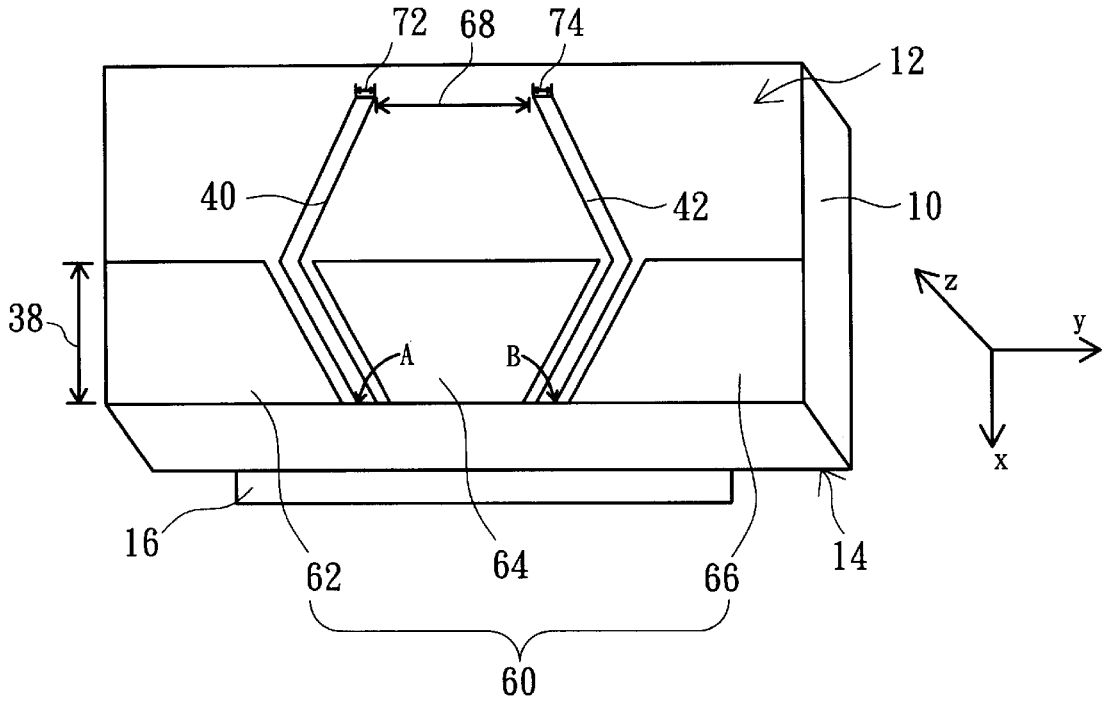
FIG. 1 is a 3-D structure diagram of an embodiment of the twin monopole antenna of the present invention.
Figure 2:
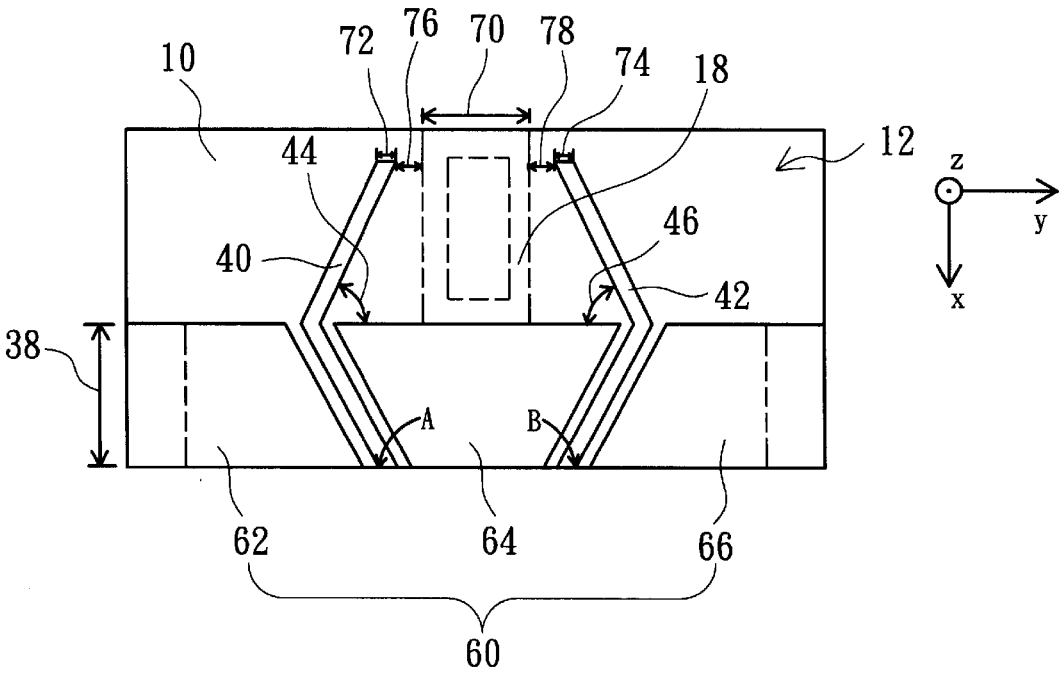
FIG. 2 is a top view showing the structure of an embodiment of the twin monopole antenna of the present invention according to FIG. 1.

Referring to FIG. 1 and FIG. 2, FIG. 1 shows a 3-D structure diagram of an embodiment of the twin monopole antenna of the present invention, and FIG. 2 is a top view showing the structure of an embodiment of the twin monopole antenna of the present invention according to FIG. 1. As shown in FIG. 2, an upper ground plane 60, a first metal line 40 and a second metal line 42 are located on a first surface 12 of a substrate 10. The upper ground plane 60 consists of a first ground plane 62, a second ground plane 64 and a third ground plane 66. In the embodiment of the present invention, the first metal line 40 and the second metal line 42 are the major radiating components and have a first metal line width 72 and a second metal line width 74 respectively. Moreover, the magnitude of a first included angle 44, an angle between the first metal line 40 and the second ground plane 64, and that of a second included angle 46, an angle between the second metal line 42 and the second ground plane 64, are designed according to the operation frequency and radiation patterns of the twin monopole antenna of the present invention, and both are in a range from about 0 degrees to about 90 degrees generally.

Figure 4:
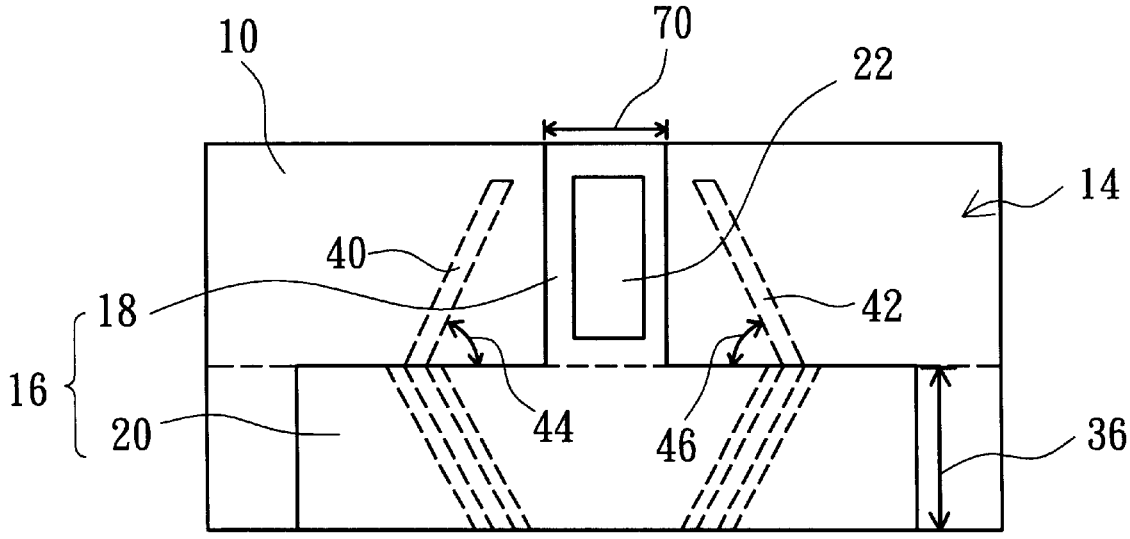
FIG. 4 is a bottom view showing the structure of an embodiment of the twin monopole antenna of the present invention according to FIG. 1.

Referring to FIG. 1 and FIG. 4, FIG. 4 is a bottom view showing the structure of an embodiment of the twin monopole antenna of the present invention according to FIG. 1. A lower ground plane 16, consisting of a fourth ground plane 20 and an inverted-U ground plane 18, is located on a second surface 14 of the substrate 10, wherein the width 36 of the fourth ground plane 20 is equal to the width 38 of the upper ground plane 60 shown in FIG. 2, and there is a hollow rectangular surface 22 in the inverted-U ground plane 18.

Figure 5:
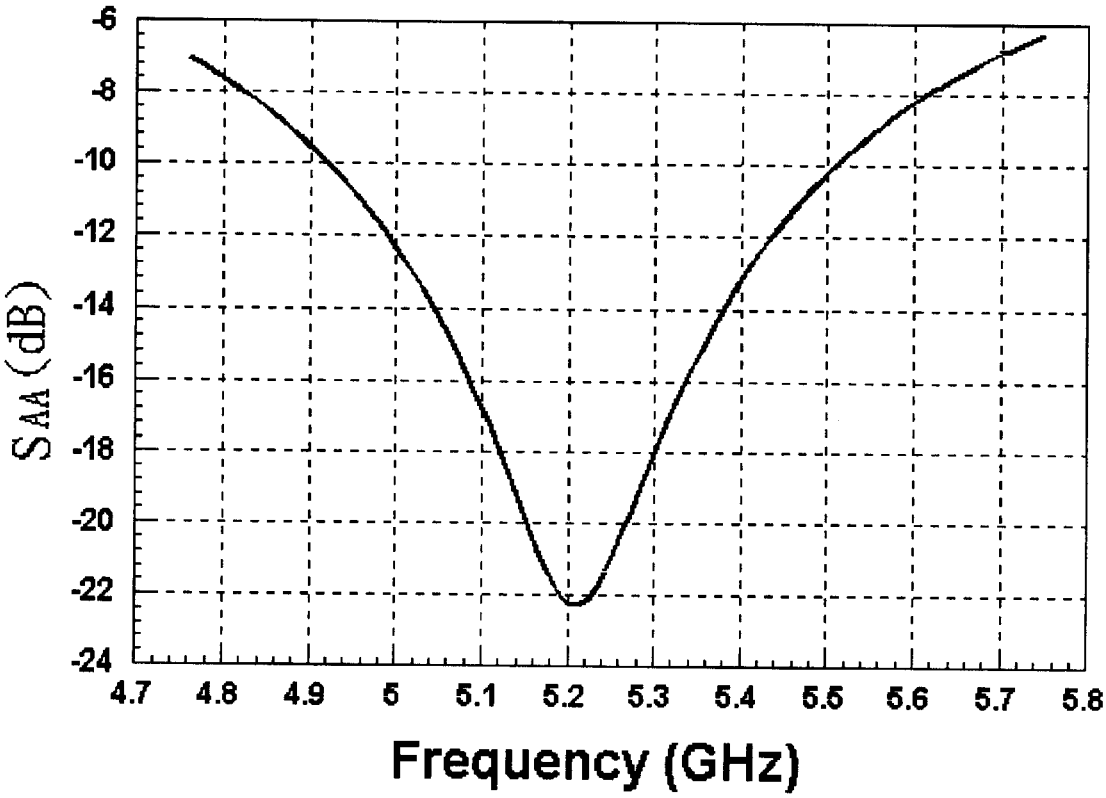
FIG. 5 is a diagram showing measured return loss of the embodiment of the present invention, which is fed through terminal A according to FIG. 1.
Figure 6:
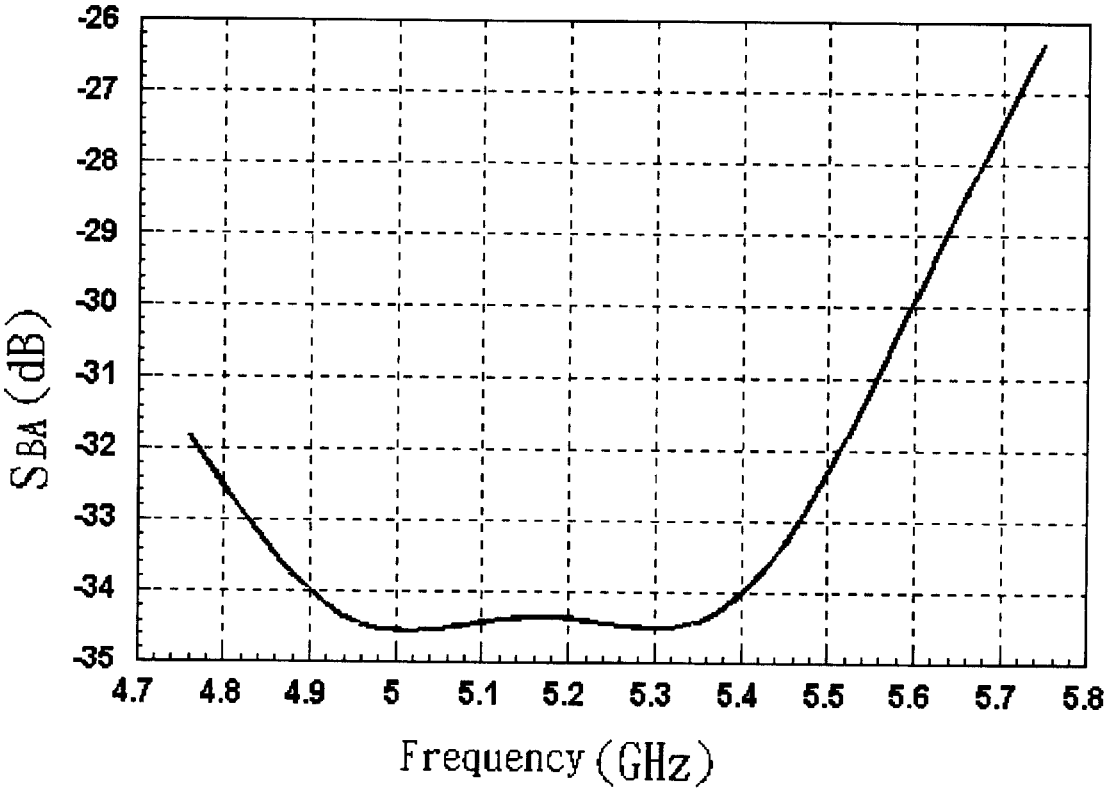
FIG. 6 is a diagram showing measured insertion loss of the embodiment of the present invention, which is fed through terminal A according to FIG. 1.

Moreover, referring to FIG. 5 and FIG. 6, FIG. 5 is a perspective diagram showing the structure of an embodiment of the twin monopole antenna of the present invention according to FIG. 2, and FIG. 6 is a perspective diagram showing the structure of an embodiment of the twin monopole antenna of the present invention according to FIG. 4. As shown in FIG. 6, between the sub-ground plane 20 and the first metal line 40 on the first surface 12, there is a first corresponding included angle 48 in x-y plane. Between the sub-ground plane 20 and the second metal line 42 on the first surface 12, there is a second corresponding included angle 50 in x-y plane, and the magnitude of the first corresponding included angle 48 and that of the second corresponding included angle 50 are designed according to the operation frequency and radiation patterns of the twin monopole antenna of the present invention, and are in a range from about 0 degrees to about 90 degrees generally.

As shown in FIG. 1, an interval 68 is located between the first metal line 40 and the second metal line 42, and larger than the width 70 of the inverted-U shaped ground plane 18 (shown in FIG. 2) generally. In addition, a first corresponding interval 76 is located between the first metal line 40 and the inverted-U shaped ground plane 18 located on the second surface 14, and a second corresponding interval 78 is located between the second metal line 42 and the inverted-U shaped ground plane 18 located on the second surface 14. The geometric structure design parameters described above, such as the interval 68, the first metal line width 72, the second metal line width 74, the first corresponding interval 76, and the second corresponding interval 78, etc., are based on the demand of operation and antenna design.

Figure 3:
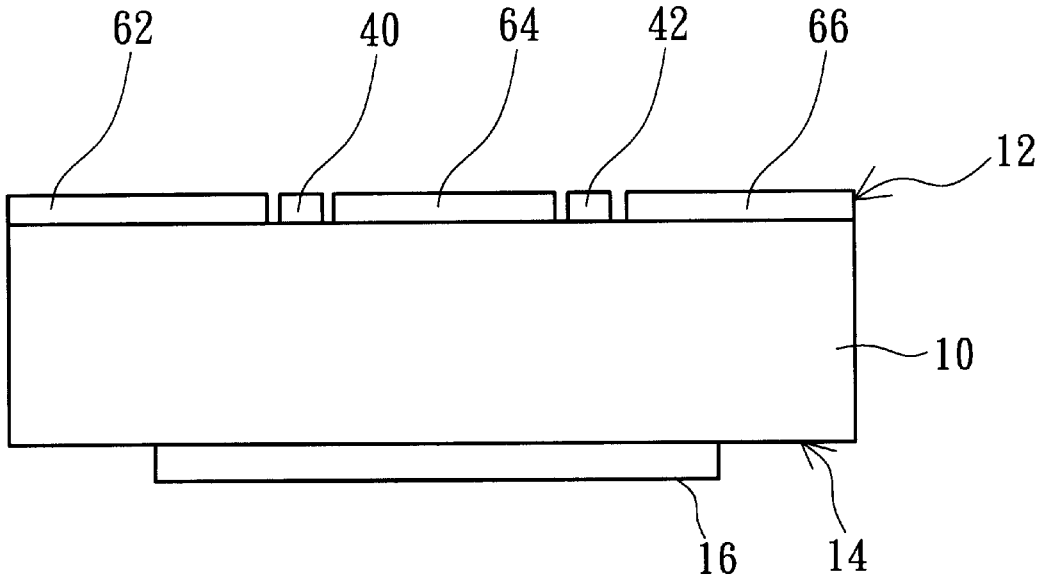
FIG. 3 is a side view on the x direction according to FIG. 1.

Referring to FIG. 1 and FIG. 3, FIG. 3 is a side view on the x direction according to FIG. 1. In the embodiment of the present invention, the major radiating components (the first metal line 40 and the second metal line 42) can be implemented by metal radiating microstrip line or other radiating components, and the substrate 10 is made of FR4. Therefore, the twin monopole antenna of the present invention can provide better performance, and the cost can also be reduced.

Figure 7:
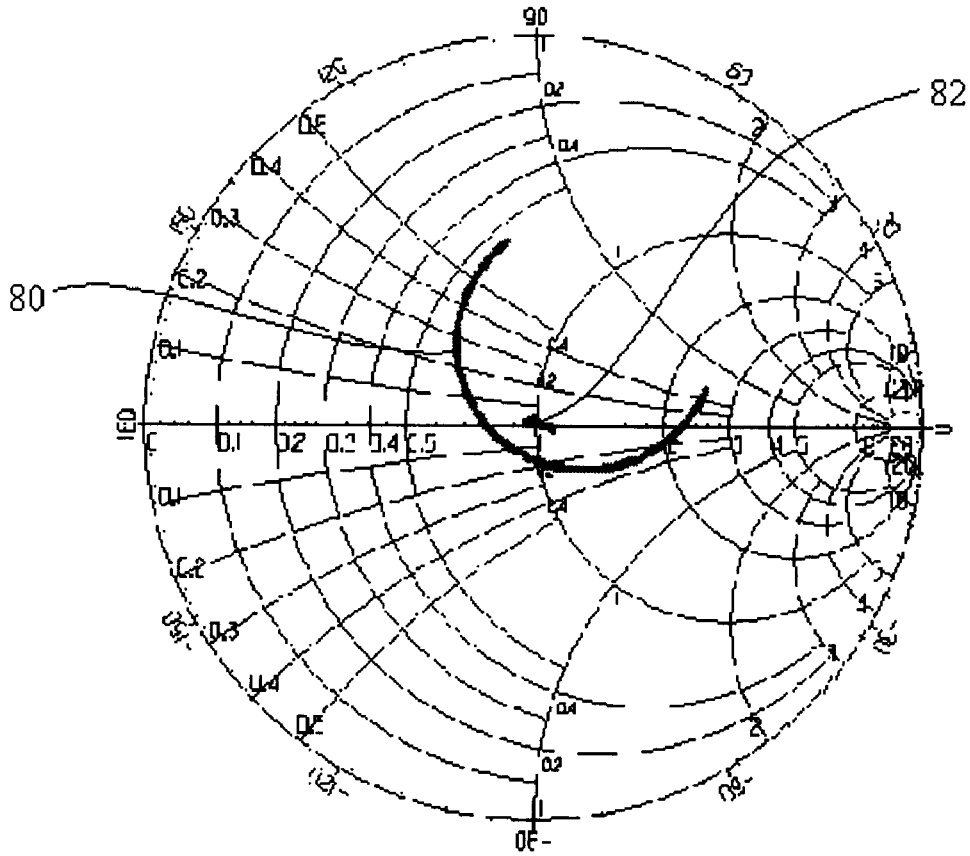
FIG. 7 is a diagram showing measured input impedance, in a Smith chart, according to the measured return loss of FIG. 5 and the measured insertion loss of FIG. 6.

Referring to FIG. 5, FIG. 5 is a diagram showing measured return loss of the embodiment of the present invention, which is fed through terminal A according to FIG. 1. Such as shown in FIG. 7, when the twin monopole antenna of the present invention is fed through the terminal A and is operated at about 5.25 GHz, the measured return loss is shown, and the operation bandwidth of the twin monopole antenna of the present invention is about 6.5% nearly with the reference of V.S.W.R.=1.5. Meanwhile, the insertion loss ($S_{B\ A}$) measured at terminal B is shown in FIG. 6.

Figure 8:
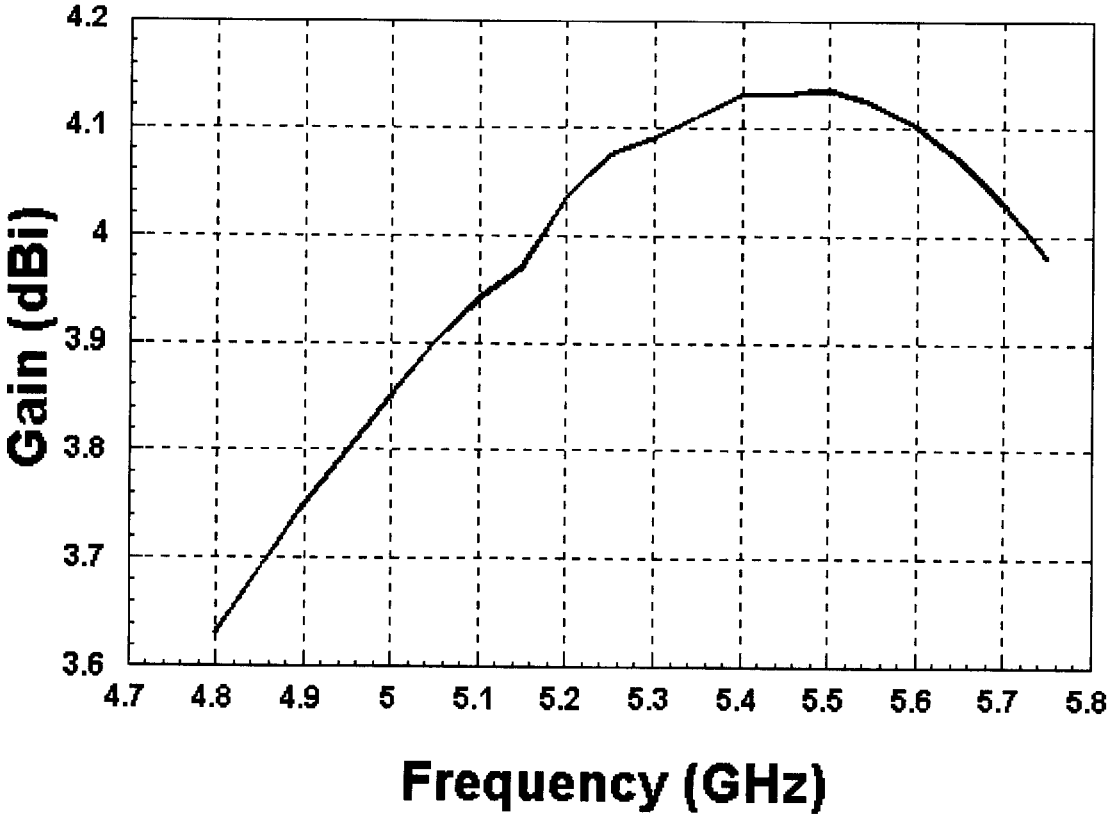
FIG. 8 is a diagram showing measured antenna gain of an embodiment of the present invention that is fed through terminal A and is operated at about 5.25 GHz.

Referring to FIG. 6, FIG. 6 is a diagram showing measured insertion loss of the embodiment of the present invention, which is fed through terminal A according to FIG. 1. As shown in FIG. 8, when the twin monopole antenna of the present invention is fed through the terminal A, the insertion loss measured at terminal B is about −34 dB. It is obvious that the isolation performance between the first metal line 40 and the second metal line 42 is better, and further referring to FIG. 7 and FIG. 8, FIG. 7 is a diagram showing measured input impedance, in a Smith chart, according to the measured return loss of FIG. 5 and the measured insertion loss of FIG. 6, wherein the curve 80 indicates the characteristic of measured return loss, and the curve 82 indicates the characteristic of measured insertion loss, and FIG. 8 is a diagram showing measured antenna gain of an embodiment of the present invention that is fed through terminal A and is operated at about 5.25 GHz.

Figure 9:
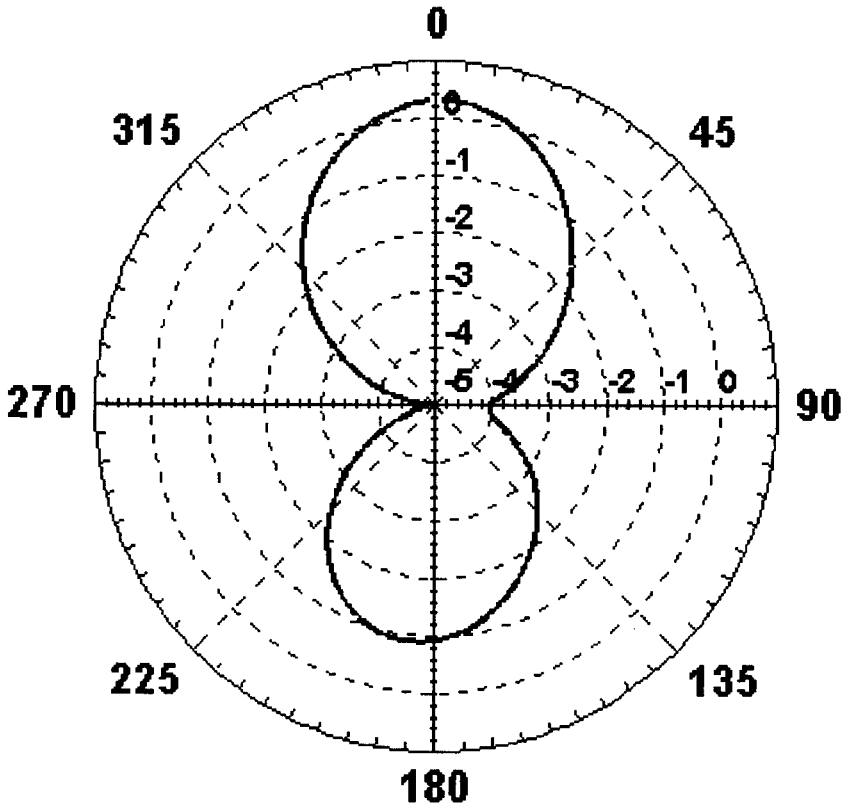
FIG. 9 is a diagram showing measured radiation pattern in x-z plane when the embodiment of the present invention shown in FIG. 1 is fed through terminal A and is operated at 5.25 GHz.
Figure 10:
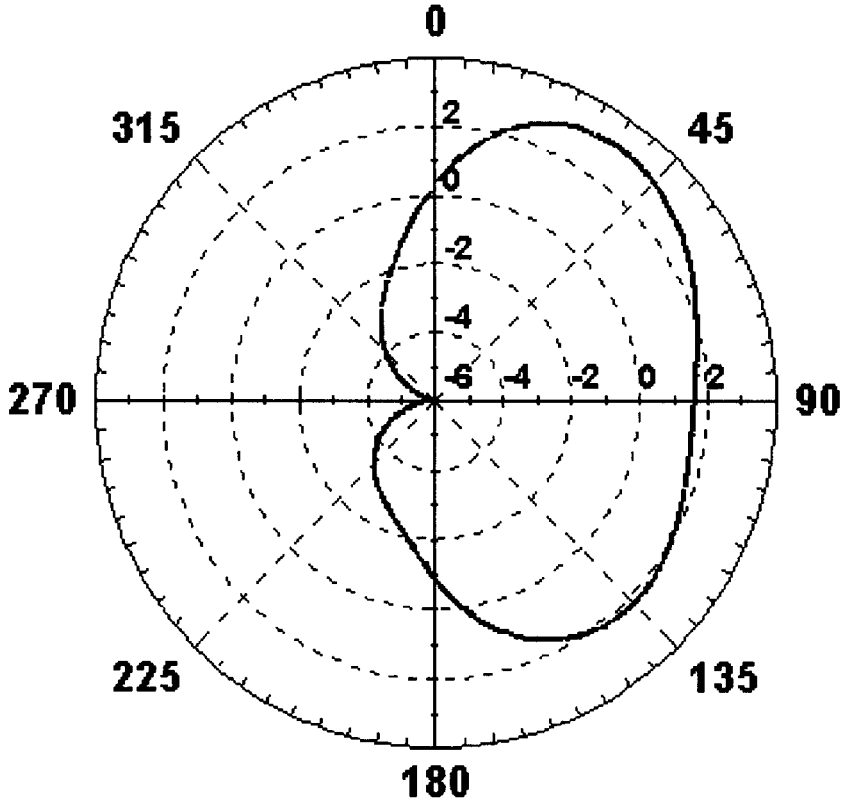
FIG. 10 is a diagram showing measured radiation pattern in y-z plane when the embodiment of the present invention shown in FIG. 1 is fed through terminal A and is operated at 5.25 GHz.
Figure 11:
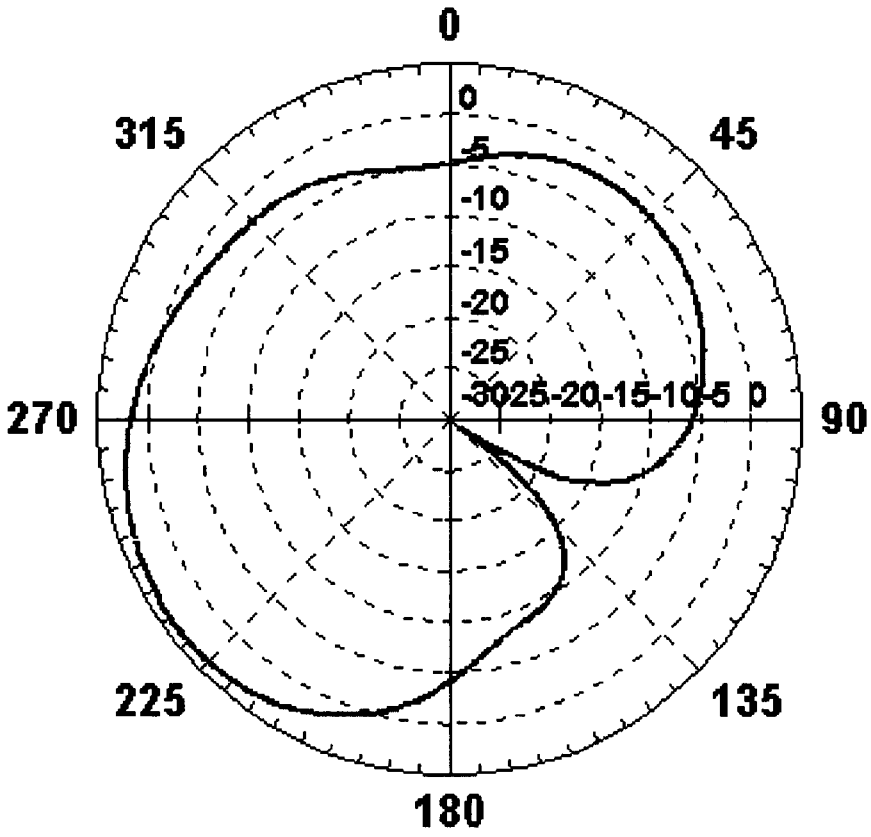
FIG. 11 is a diagram showing measured radiation pattern in x-y plane when the embodiment of the present invention shown in FIG. 1 is fed through terminal A and is operated at 5.25 GHz.

Referring to FIG. 9, FIG. 10 and FIG. 11, FIG. 9 is a diagram showing measured radiation pattern in x-z plane when the embodiment of the present invention shown in FIG. 1 is fed through terminal A and is operated at 5.25 GHz, and FIG. 10 is a diagram showing measured radiation pattern in y-z plane when the embodiment of the present invention shown in FIG. 1 is fed through terminal A and is operated at 5.25 GHz, and FIG. 11 is a diagram showing measured radiation pattern in x-y plane when the embodiment of the present invention shown in FIG. 1 is fed through terminal A and is operated at 5.25 GHz.

As shown in FIG. 11, the magnitude of the measured radiation pattern in x-y plane is smaller in the range from 90 degrees to 180 degrees (the position of the second metal line 42). Apparently, the isolation between the first metal line 40 and the second metal line 42 is excellent, which means that, when one of the two metal lines has poor radiation performance, the other one will not be affected thereby, and still can have a certain degree of radiation performances.

The advantage of the present invention is to provide a twin monopole antenna. More particularly, the present invention relates to a twin monopole antenna that is fed by a twin coplanar waveguide. By adjusting the parameters of two radiating monopole antennas, such as lengths, widths, shapes and included angles, etc., the demanded operating frequency can be attained easily. Moreover, because the isolation between those two monopole antennas is excellent, the twin monopole antenna of the present invention provides the broader radiating pattern, and meanwhile also has the features of the lower return loss and insertion loss. Therefore, the good impedance matching and operation performance can be obtained. In addition, because the structure of the present invention is simple, the implementation of the present invention can be manufactured easily on a substrate, so that the cost is lowered and the implementation is valuable in industrial field.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A twin monopole antenna, which is fed by a twin coplanar waveguide and is used in wireless communications, comprising:

a substrate consisting of a first surface and a second surface, wherein the first surface is located on one side of the substrate and the second surface is located on the other side of the substrate;

a ground plane comprising:

a first ground plane located on the first surface of the substrate; and a second ground plane located on the second surface of the substrate, and the second ground plane is consisting of a third ground plane and an inverted-U shaped ground plane;

a first radiating antenna located on the first surface of the substrate, and has a first width, wherein a first included angle is located between the first radiating antenna and the first ground plane; and a second radiating antenna located on the first surface of the substrate, and has a second width, wherein a second included angle is located between the second radiating antenna and the first ground plane, and an interval is located between the first radiating antenna and the second radiating antenna.

2. The twin monopole antenna of claim 1, wherein the inverted-U shaped ground plane has a hollow rectangular surface.

3. The twin monopole antenna of claim 1, wherein a first corresponding interval is located between the first radiating antenna and the inverted-U shaped ground plane.

4. The twin monopole antenna of claim 3, wherein a second corresponding interval is located between the first radiating antenna and the inverted-U shaped ground plane.

5. The twin monopole antenna of claim 1, wherein the substrate is a FR4 substrate.

6. The twin monopole antenna of claim 1, wherein the first radiating antenna is a first radiating metal line.

7. The twin monopole antenna of claim 6, wherein the second radiating antenna is a second radiating metal line.

8. The twin monopole antenna of claim 1, wherein the ground plane is a metal ground plane.

9. The twin monopole antenna of claim 1, wherein the magnitude of the first included angle is in a range from 0 degrees to 90 degrees.

10. The twin monopole antenna of claim 1, wherein the magnitude of the second included angle is in a range from 0 degrees to 90 degrees.

11. The twin monopole antenna of claim 1, wherein the width of the first radiating antenna is equal to the width of the second radiating antenna.

12. The twin monopole antenna of claim 1, wherein the magnitude of the first included angle is equal to the degree of the second included angle.

13. A twin monopole antenna, is implemented in a wireless communication, comprising:

a substrate consisting of a first surface and a second surface, wherein the first surface is located on one side of the substrate and the second surface is located on the other side of the substrate;

a first ground plane located on the first surface of the substrate, and the first ground plane is consisting of a second ground plane, a third ground plane and a fourth ground plane;

a fifth ground plane located on the second surface of the substrate, the fifth ground plane comprising:

a sixth ground plane; and an inverted-U shaped ground plane, wherein the inverted-U shaped ground plane has a hollow rectangular surface;

a first radiating line, that is located on the first surface of the substrate, and has a first width, wherein a first included angle is located between the first radiating line and the third ground plane, and a first corresponding interval is located between the first radiating line and the inverted-U shaped ground plane; and a second radiating line, that is located on the first surface of the substrate and has a second width, wherein a second included angle is located between the second radiating line and the third ground plane, and a second corresponding interval is located between the second radiating line and the inverted-U shaped ground plane, and an interval is located between the first radiating line and the second radiating line.

14. The twin monopole antenna of claim 13, wherein the substrate is a FR4 substrate.

15. The twin monopole antenna of claim 13, wherein the first radiating line is a first radiating metal line.

16. The twin monopole antenna of claim 15, wherein the second radiating line is a second radiating metal line.

17. The twin monopole antenna of claim 13, wherein the first ground plane and the fifth ground plane are made of metal.

18. The twin monopole antenna of claim 13, wherein the magnitude of the first included angle is in a range from 0 degrees to 90 degrees.

19. The twin monopole antenna of claim 13, wherein the magnitude of the second included angle is in a range from 0 degrees to 90 degrees.

20. The twin monopole antenna of claim 13, wherein the width of the first radiating metal line is equal to the width of the second radiating metal line.

21. The twin monopole antenna of claim 13, wherein the degree of the first included angle is equal to the degree of the second included angle.

* * * * *